US006679763B2

(12) United States Patent
Boyd et al.

(10) Patent No.: US 6,679,763 B2
(45) Date of Patent: Jan. 20, 2004

(54) APPARATUS AND METHOD FOR QUALIFYING A CHEMICAL MECHANICAL PLANARIZATION PROCESS

(75) Inventors: John M. Boyd, Atascadero, CA (US); Katrina Mikhaylich, San Jose, CA (US); Mike Ravkin, Sunnyvale, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/078,941

(22) Filed: Feb. 20, 2002

(65) Prior Publication Data

US 2002/0081951 A1 Jun. 27, 2002

Related U.S. Application Data

(63) Continuation of application No. 09/608,522, filed on Jun. 30, 2000, now Pat. No. 6,435,952.

(51) Int. Cl.[7] ..... B24B 53/00
(52) U.S. Cl. ..... 451/56; 451/443; 451/72
(58) Field of Search ..... 451/56, 72, 443, 451/444, 21, 288, 287

(56) References Cited

U.S. PATENT DOCUMENTS

| | | | |
|---|---|---|---|
| 3,753,269 | A | 8/1973 | Budman |
| 4,318,250 | A | 3/1982 | Klievoneit et al. |
| 4,672,985 | A | 6/1987 | Mohr |
| 4,720,939 | A | 1/1988 | Simpson et al. |
| 4,934,102 | A | 6/1990 | Leach et al. |
| 5,081,051 | A | 1/1992 | Mattingly et al. |
| 5,096,854 | A | 3/1992 | Saito et al. |
| 5,335,453 | A | 8/1994 | Baldy et al. |
| 5,433,650 | A | 7/1995 | Winebarger |
| 5,456,627 | A | 10/1995 | Jackson et al. |
| 5,484,323 | A | 1/1996 | Smith |
| 5,531,635 | A | 7/1996 | Mogi et al. |
| 5,536,202 | A | 7/1996 | Appel et al. |
| 5,547,417 | A | 8/1996 | Breivogel et al. |
| 5,558,568 | A | 9/1996 | Talieh et al. |
| 5,575,707 | A | 11/1996 | Talieh et al. |
| 5,593,344 | A | 1/1997 | Weldon et al. |
| 5,611,943 | A | 3/1997 | Cadien et al. |
| 5,622,526 | A | 4/1997 | Phillips |
| 5,643,044 | A | 7/1997 | Lund |
| 5,655,951 | A | 8/1997 | Meikle et al. |
| 5,692,947 | A | 12/1997 | Talieh et al. |
| 5,692,950 | A | 12/1997 | Rutherford et al. |
| 5,725,417 | A | 3/1998 | Robinson |
| 5,759,918 | A | 6/1998 | Hoshizaki et al. |
| 5,762,536 | A | 6/1998 | Pant et al. |
| 5,779,526 | A | 7/1998 | Gill |
| 5,871,390 | A | 2/1999 | Pant et al. |
| 5,890,951 | A | 4/1999 | Vu |
| 5,897,426 | A | 4/1999 | Somekh |
| 5,899,798 | A | 5/1999 | Trojan et al. |
| 5,908,530 | A | 6/1999 | Hoshizaki et al. |
| 5,958,794 | A | 9/1999 | Bruxvoort et al. |
| 6,086,460 | A | 7/2000 | Labunsky et al. |
| 6,261,959 | B1 | 7/2001 | Travis et al. |
| 6,306,019 | B1 | 10/2001 | Finkelman |

FOREIGN PATENT DOCUMENTS

| | | |
|---|---|---|
| WO | WO 98/45090 | 10/1998 |
| WO | WO 99/22908 | 5/1999 |

OTHER PUBLICATIONS

S. Inaba, T. Katsuyama, M. Tanaka, "Study of CMP Polishing pad Control Method," 1998 CMP–MIC Conference, Feb. 19–20, 1998, 1998 IMIC—300P/98/0444.

*Primary Examiner*—Robert A. Rose
(74) *Attorney, Agent, or Firm*—Brinks Hofer Gilson & Lione

(57) ABSTRACT

A method and apparatus for qualifying a polishing pad used in chemical mechanical planarization of semiconductor wafers is described. The apparatus includes at least one qualifying member including at least one collimated hole structure, wherein the collimated hole structure forms multiple channels within the qualifying member. The method includes providing at least one qualifying member formed with at least one capillary tube array, wherein the capillary tube array forms multiple channels within the qualifying member, pressing the qualifying member against the polishing pad, and moving the qualifying member along the polishing pad along a trajectory to simulate the polishing of a semiconductor wafer.

20 Claims, 4 Drawing Sheets

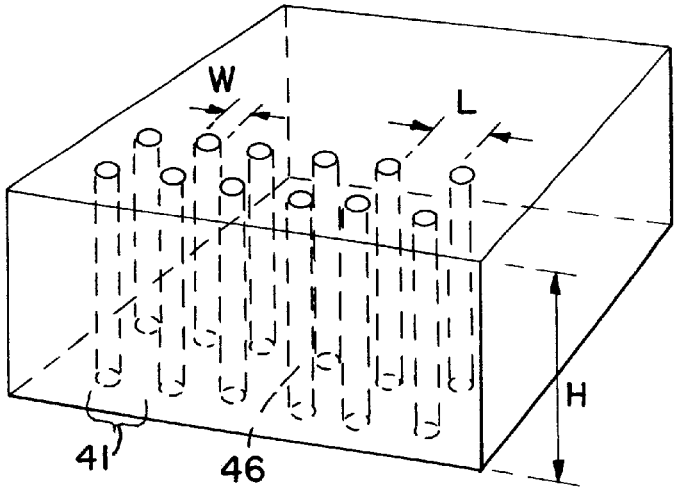
FIG. 4
FIG. 5
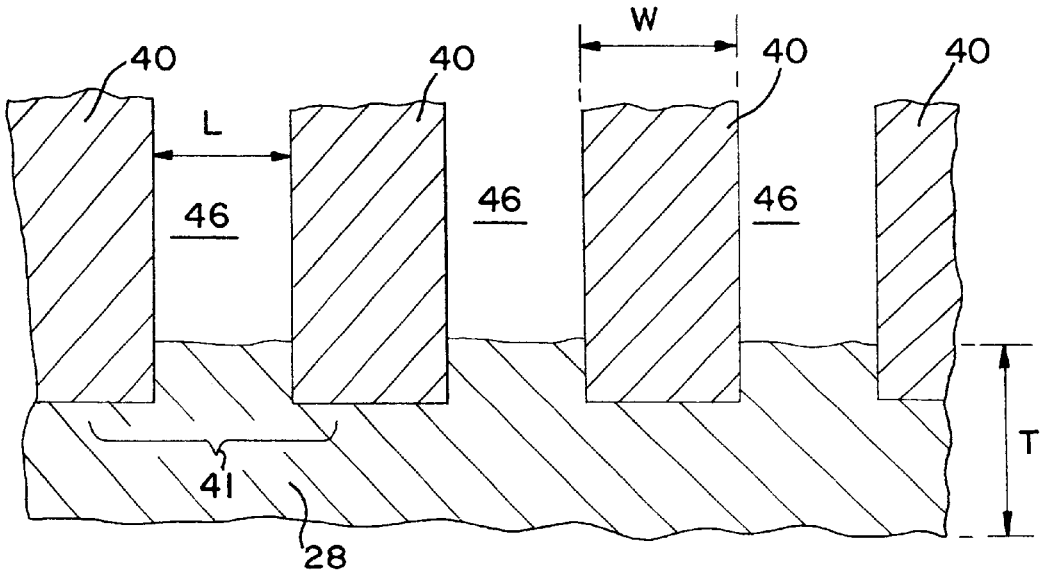

APPARATUS AND METHOD FOR QUALIFYING A CHEMICAL MECHANICAL PLANARIZATION PROCESS

CROSS REFERENCE TO RELATED APPLICATIONS

This applicaton is a continuation of application Ser. No. 09/608,522, filed Jun. 30, 2000, now U.S. Pat. No. 6,435,952 (pending) which is hereby incorporated by reference herein.

Related subject matter is disclosed in a commonly-owned, co-pending patent application entitled "APPARATUS AND METHOD FOR CONDITIONING A FIXED ABRASIVE POLISHING PAD IN A CHEMICAL MECHANICAL PLANARIZATION SYSTEM" Attorney Docket No. 7103/180, filed on even date herewith.

FIELD OF THE INVENTION

The present invention relates to an apparatus and method for qualifying a chemical mechanical planarization process. More particularly, the present invention relates to an apparatus and method for qualifying a polishing pad used in the chemical mechanical planarization of semiconductor wafers.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected unevenness in the wafer surface. This sensitivity is accentuated with the current drive toward smaller, more highly integrated circuit designs. Semiconductor devices are also commonly constructed in layers, where a portion of a circuit is created on a first level and conductive vias are made to connect up to the next level of the circuit. After each layer of the circuit is etched on a semiconductor wafer, an oxide layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. In some CMP systems, a polishing fluid, such as a chemical polishing agent or slurry containing microabrasives, is applied to the polishing pad to polish the wafer. In other CMP systems, a fixed abrasive pad is used to polish the wafer. The wafer holder then presses the wafer against the rotating polishing pad and is rotated to polish and planarize the wafer.

CMP systems using a polishing fluid or a fixed abrasive often undergo pad wear studies for simulating extended patterned wafer runs. These pad wear studies are often necessary in order to bring a new process into production. In order to conduct these pad wear studies, hundreds of patterned semiconductor wafers are often required for process qualification marathons with a single structure. These hundreds of semiconductor wafers cost a considerable amount of money to manufacture and develop. Accordingly, further development of an apparatus and method for qualifying a chemical mechanical planarization process, and more specifically, for qualifying a polishing pad used in the chemical mechanical planarization of semiconductor wafers, is necessary in order to decrease the costs of pad wear studies, which in turn decreases the costs of bringing new CMP processes into production and decreases the cost of CMP process development.

SUMMARY

According to a first aspect of the present invention, an apparatus for qualifying a polishing pad used in chemical mechanical planarization of semiconductor wafers is provided. The apparatus includes at least one qualifying member including at least one collimated hole structure, wherein the collimated hole structure forms multiple channels within the qualifying member. In one embodiment, the qualifying member includes a material selected from the group consisting of borosilicate glass, soda lime glass, high-lead glass, and silicon oxide. In another embodiment, each channel within each collimated hole structure has a width of between about 3 microns and about 100 microns.

According to another aspect of the present invention, a method for qualifying a polishing pad used in chemical mechanical planarization of semiconductor wafers is provided. The method includes providing at least one qualifying member formed with at least one capillary tube array, wherein the capillary tube array forms multiple channels within the qualifying member, pressing the qualifying member against the polishing pad, and moving the qualifying member along the polishing pad along a trajectory to simulate the polishing of a semiconductor wafer. In one embodiment, the polishing pad contains an amount of slurry. In one embodiment, the polishing pad includes a fixed abrasive.

BRIEF DESCRIPTION OF THE DRAWINGS

FIG. 4 is an enlarged perspective view of a qualifying member for a pad qualifying apparatus;

FIG. 5 is an enlarged cross-sectional view of a qualifying member qualifying a polishing pad;

Figure 1:
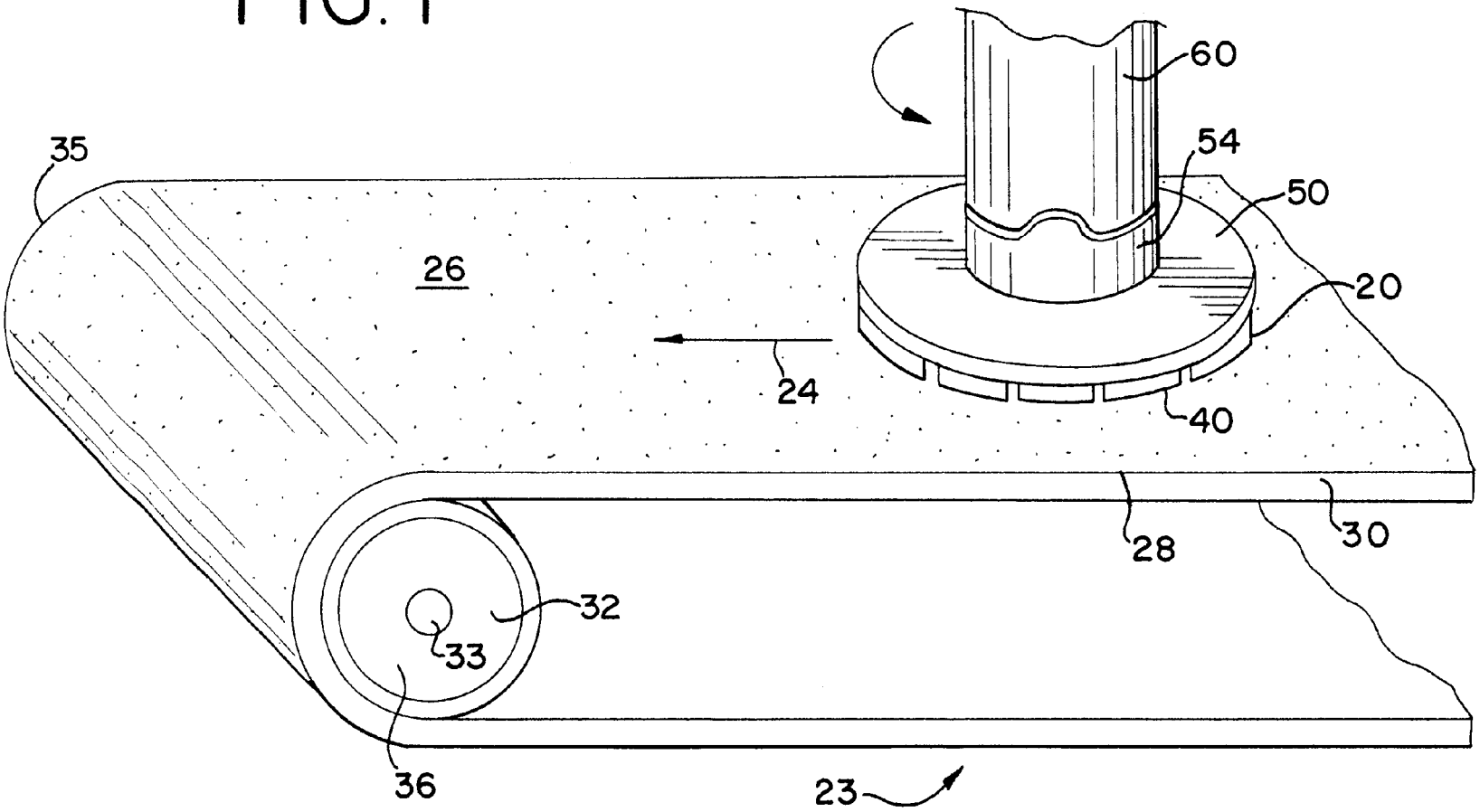
FIG. 1 is a perspective view of a preferred embodiment of a pad qualifying apparatus.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF THE PRESENTLY PREFERRED EMBODIMENTS

FIG. 1 illustrates a presently preferred embodiment of qualifying apparatus 20 according to the present invention. Qualifying apparatus 20 is used to qualify polishing pad 28, preferably for use in chemical mechanical planarization of semiconductor wafers 22. Qualifying apparatus 20 includes at least one collimated hole structure 41, as illustrated in FIGS. 4–5. Collimated hole structure 41 includes at least one or more channels 46 formed through a qualifying member 40, as illustrated in FIGS. 4–5. Channels 46 are formed in a manner so that each channel 46 is generally parallel to each adjacent channel 46. Preferable, the channels 46 are generally cylindrical in shape. However, channels 46 may form any one of a number of shapes, such as parallelepiped, or have any one of a number of cross sections, such as triangular, or have any irregular shape or cross section. Preferably, channels 46 are continuous and have a generally consistent width W and length L between channels. The width W of each channel and the length L between each channel is designed so as to simulate the features found on a semiconductor wafer. Preferably, channels 46 within each collimated hole structure 41 have a width W of between about 3 microns and about 100 microns. The length L between each channel 46 within each collimated hole structure 41 is preferably between about 3 microns and about 100 microns. Preferably, the height H of the collimated hole structures 41 is greater than the height of a semiconductor wafer, and more preferably, the collimated hole structures 41 have a height H, that is between about 2 millimeters to about 6 millimeters. The removal rate for qualifying member 40, that is the rate at which qualifying member 40 can remove particles from polishing pad 28, is between about 2000 angstroms/min to about 5000 angstroms/min. This results in a polishing time of about 2 minutes per semiconductor wafer. Therefore, every 1 mm of thickness in qualifying member 40 is sufficient to simulate the polishing of approximately 1000 patterned wafers. Qualifying member 40 includes a material with a similar density and structure as a semiconductor wafer, such as, for example, borosilicate glass, soda lime glass, high-lead glass, and silicon oxide. Collimated hole structures 41 are also known as capillary arrays and may be obtained from Collimated Holes, Inc. of 460 Division Street, Campbell, Calif. 95008. Typically, collimated hole structures 41 come in either the shape of a bar or the shape of a disc.

Collimated hole structures 41 may be produced in any one of a number of methods. In one method, long, hollow tubes of glass are bundled together inside of a larger glass tube, the entire assembly is then reduced to the desired width through a drawing, or stretching, process. Drawn capillaries exhibit pristine, firepolished inner walls. In another method, collimated hole structures 41 are produced using an etching process. In this method, a block of material is produced in which soluble glass fibers are surrounded by insoluble claddings, forming a regular matrix. After the block has been fused, plates are sliced, polished, and placed in an acid bath. The core glass is etched away, leaving a structure of very precise holes in the residual matrix. Etched plate arrays contain holes throughout the entire matrix, all the way to the edges of the plate.

Figure 3:
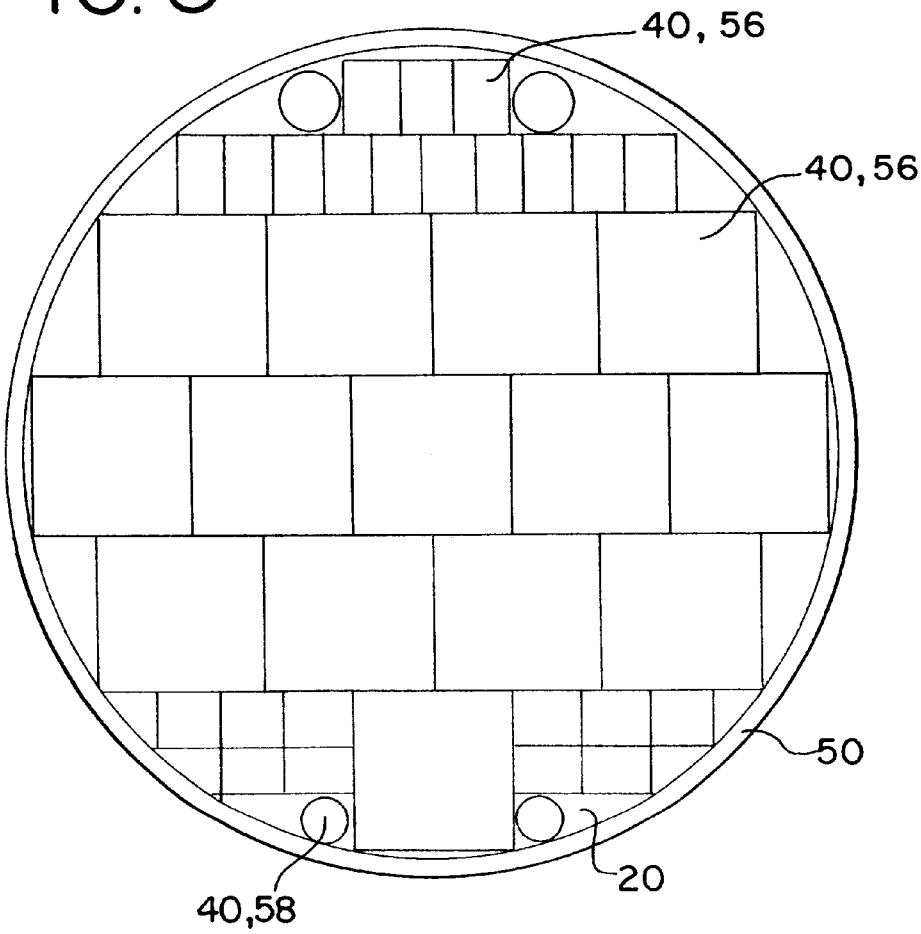
FIG. 3 is a bottom view of the pad qualifying apparatus in FIG. 2.

Qualifying apparatus 20 includes at least one qualifying member 40, as illustrated in FIG. 3. Qualifying member 40 can be formed in any one of a variety of shapes. In one preferred embodiment, qualifying member 40 is formed in the shape of a bar 56, as illustrated in FIG. 3. In one preferred embodiment, qualifying member 40 is formed in the shape of a disc 58, as illustrated in FIG. 3. In one preferred embodiment, qualifying apparatus 20 includes a series of qualifying members 40 in the shape of bars 56 and/or discs 58 that are combined together and placed adjacent to each other in order to approximate the shape of a semiconductor wafer, as illustrated in FIG. 3. In one preferred embodiment, qualifying apparatus 20 includes a single qualifying member 40 in the shape of a bar 56 or a disc 58 in order to approximate the shape of a semiconductor wafer. In one preferred embodiment, qualifying member 40 has a size and shape that approximates that of a semiconductor wafer.

Figure 2:
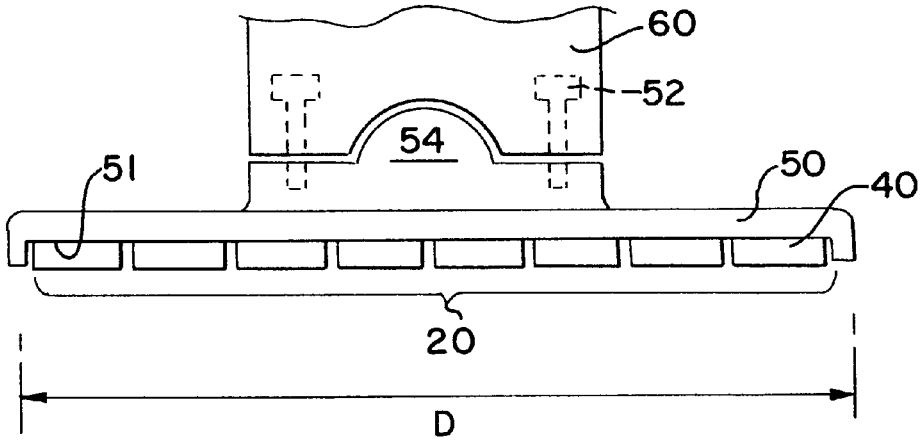
FIG. 2 is an enlarged side view of the pad qualifying apparatus in FIG. 1.

Qualifying apparatus 20 is mounted or attached onto a retaining fixture 50, as illustrated in FIGS. 2–3. Preferably, qualifying apparatus 20 is attached to retaining fixture 50 using any attachment means know to those of skill in the art, such as a retaining ring, a hook and loop type fastener (such as VELCRO™), a screw, a belt, a cable, a snap-fit member, an adhesive, a captivating spring, or any other type of means for attaching one member to a second member. Preferably, qualifying apparatus 20 is removably attached to retaining fixture 50, however, qualifying apparatus 20 may be fixedly attached to retaining fixture 50. Retaining fixture 50 forms a cavity 51 within which qualifying apparatus 20 rests. Retaining fixture 50 is connected to a gimbal 54 which is used to retain retaining fixture 50 in a level position when retaining fixture is connected with gimbal shaft 60. Preferably, gimbal 54 is connected with gimbal shaft 60 through a series of bolts 52. Bolts 52 secure gimbal 54 to gimbal shaft 60. Gimbal shaft 60 rotates gimbal 54, which in turn causes retaining fixture 50 and qualifying apparatus 20 to rotate. Gimbal shaft 60 and polishing pad 28 are used in and connected with a typical CMP system, or wafer polisher 23, as illustrated in FIG. 1.

Preferably, qualifying apparatus 20 is in direct contact with the surface of polishing pad 28, as illustrated in FIGS. 1 and 5. Qualifying apparatus 20 has a width or diameter D defined as the distance from one end of qualifying apparatus 20 to a second end of qualifying apparatus 20, as illustrated in FIG. 2. Preferably, qualifying apparatus 20 has a width or diameter D that is equal to a substantial amount of or greater than the diameter of a semiconductor wafer in order to allow qualifying apparatus 20 to simulate the polishing of a semiconductor wafer. In one preferred embodiment, qualifying apparatus 20 has a width or diameter D that is between about 5 centimeters to about 30 centimeters. By mounting qualifying apparatus 20 in retaining fixture 50, by connecting retaining fixture 50 to gimbal shaft 60, and by giving qualifying apparatus 20 a width or diameter D that is equal to a substantial amount of or greater than the diameter of a semiconductor wafer, qualifying apparatus 20 is able to simulate the size and movement of a semiconductor wafer within a CMP system, or wafer polisher 23. In one preferred embodiment, qualifying apparatus 20 has a width or diameter D that is less than the diameter of a semiconductor wafer.

Preferably, qualifying apparatus 20 forms a generally circular footprint over polishing pad 28, as illustrated in FIGS. 1 and 4, in order to simulate the footprint of a semiconductor wafer. However, as known by one of ordinary skill in the art, qualifying apparatus 20 can form footprints with a variety of shapes such as a rectangular shape, a square shape, a v-shape, a w-shape, a u-shape, and any other regular or irregularly shaped footprint over polishing pad 28.

Figure 6:
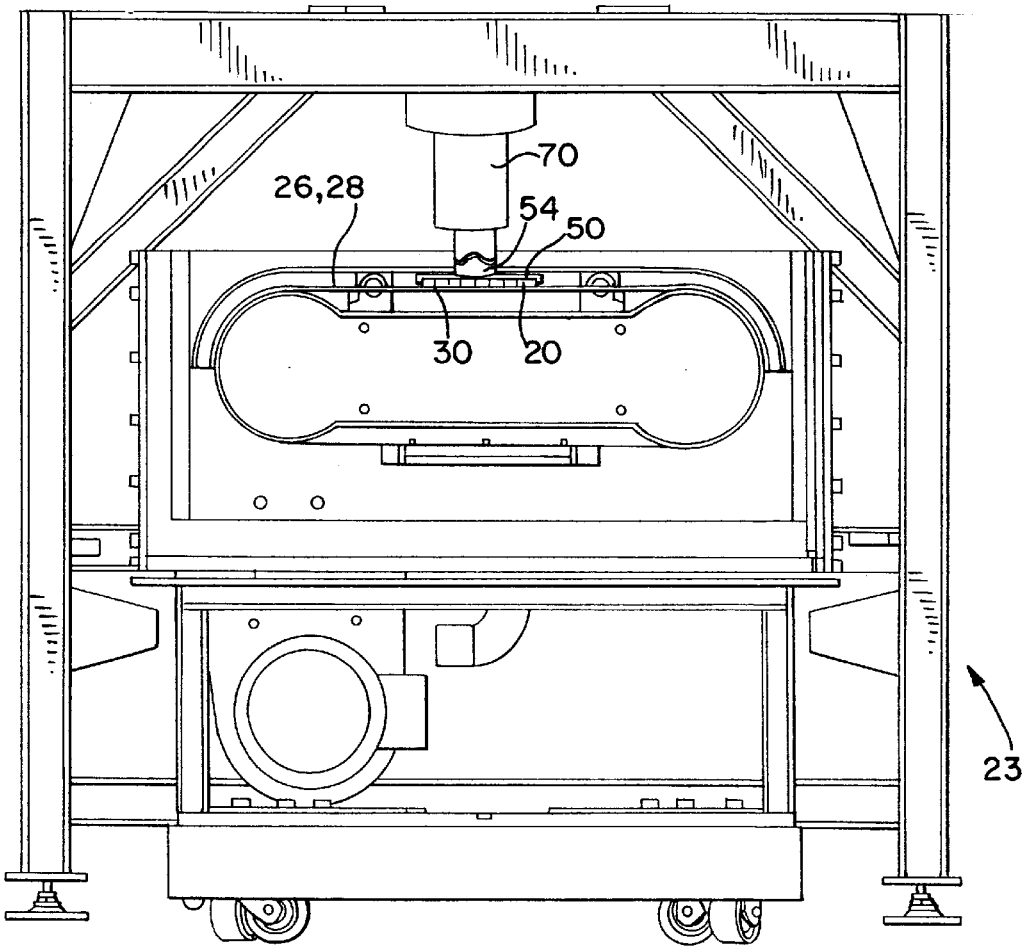
FIG. 6 is a side view of a linear wafer polisher.

In one preferred embodiment, wafer polisher 23 is a linear belt polisher having polishing pad 28 mounted on linear belt 30 that travels in a forward direction 24, as illustrated in FIG. 1. In this embodiment, linear belt 30 is mounted on a series of rollers 32. Rollers 32 preferably include coaxially disposed drive shafts 33 extending through the length of rollers 32. Alternatively, each drive shaft 33 may be two separate coaxial segments extending partway in from each of the ends 35, 36 of rollers 32. In yet another embodiment, each drive shaft 33 may extend only partly into one of the ends 35, 36 of rollers 32. Connectors (not shown) on either end 35, 36 of rollers 32 hold each drive shaft 33. A motor 70 connects with at least one drive shaft 33 and causes rollers 32 to rotate, thus moving linear belt 30 and polishing pad 28. Preferably, polishing pad 28 is stretched and tensed when mounted on rollers 32, thus causing pores of on the surface of polishing pad 28 to open in order more easily loosen and remove slurry 26 from polishing pad 28. In one preferred embodiment, polishing pad 28 is stretched and tensed to a tension of approximately 1100 lbs. FIG. 6 illustrates one environment in which a preferred embodiment of qualifying apparatus 20 may operate. In FIG. 6, qualifying apparatus 20 is positioned on retaining fixture 50 attached to a gimbal 54 and gimbal shaft 60 within wafer polisher 23. The wafer polisher 23 may be a linear belt polisher such as the TERES™ polisher available from Lam Research Corporation of Fremont, Calif. The alignment of the qualifying apparatus 20 with respect to the polishing pad 28 is best shown in FIGS. 1 and 6.

Figure 7:
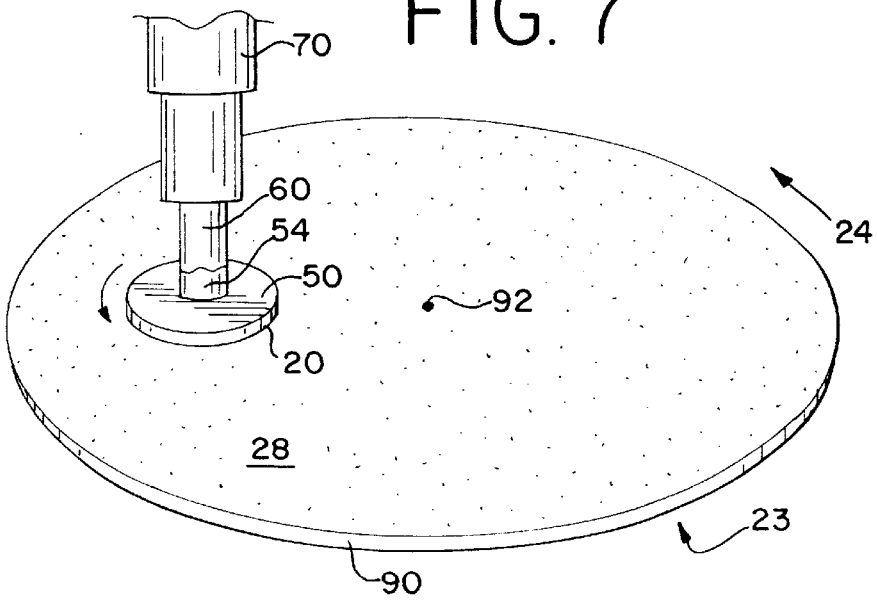
FIG. 7 is a perspective view of a rotary wafer polisher.

In one preferred embodiment, wafer polisher 23 is a rotary wafer polisher having polishing pad 28 mounted on circular disc 90 that rotates in one direction, as illustrated in FIG. 7. Circular disc 90 rotates about shaft 92 while qualifying apparatus 20 and retaining fixture 50 rotate about gimbal shaft 60 located a distance away from shaft 92. Preferably, shaft 92 is positioned coaxially with gimbal shaft 60. In this embodiment, wafer polisher 23 may be a rotary wafer polisher such as the Mirra polisher available from Applied Materials of Santa Clara, Calif. The alignment of the qualifying apparatus 20 with respect to the polishing pad 28 is best shown in FIG. 7.

When wafer polisher 23 is activated, belt 30 beings to move in a forward direction 24, as illustrated in FIGS. 1 and 7. In one preferred embodiment, a polishing fluid, such as a chemical polishing agent or slurry 26 containing microabrasives, is applied to the polishing pad 28 for polishing a semiconductor wafer. In this embodiment, as belt 30 moves, slurry 26 is applied using a slurry applicator. Qualifying apparatus 20 is then pressed against and moved across polishing pad 28 along a trajectory to simulate the polishing of a semiconductor wafer. Preferably, qualifying apparatus 20 is pressed against polishing pad 28 with a force of between about 0.5 psi and about 4.0 psi. In one preferred embodiment, polishing pad 28 is moves across qualifying apparatus 20 at a speed of about 25 centimeters/second to about 200 centimeters/second. Upon moving qualifying apparatus 20 across polishing pad 28, polishing pad 28 becomes worn down, as illustrated in FIG. 5. By wearing down polishing pad 28 in a manner similar to that of a semiconductor wafer, qualifying apparatus 20 is able to simulate a wafer polishing event. An advantage of the presently preferred qualifying apparatus 20 is that by using qualifying apparatus 20 to simulate a wafer polishing event, one is able to replace hundreds of patterned semiconductor wafers costing much more than one single qualifying apparatus 20. Thus, qualifying apparatus 20 can reduce the costs of pad wear studies, which in turn reduces the costs of bringing new CMP processes into production and reduces the cost of CMP process development.

In one preferred embodiment, to simulate a pad wear, qualifying apparatus 20 is mounted onto a retaining fixture 50 and the retaining fixture is connected with a CMP system. Preferably the height H of the collimated hole structures 41, and thus the height H of the qualifying member 40, is approximately between about 2 millimeters and about 10 millimeters in order to simulate the wear on polishing pad 28 of about 2000 to about 10,000 semiconductor wafers. In one preferred embodiment, more than one qualifying apparatus 20 is used in order to simulate the wear on polishing pad 28 of about 500 to about 10000 semiconductor wafers. In one preferred embodiment, a single qualifying apparatus 20 is used to simulate wear on more than one polishing pad 28. In order to simulate the wear on polishing pad 28, qualifying apparatus 20 is pressed against polishing pad 28, and polishing pad 28 is moved across qualifying apparatus 20 at the same rate and for the same time as at least one or more semiconductor wafers would be for the process that is being simulated in order to asses pad wear of that process.

Thus, there has been disclosed in accordance with the invention, an apparatus and method for qualifying a chemical mechanical planarization process that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications that fall within the scope of the appended claims and equivalents thereof.

What is claimed is:

1. An apparatus for qualifying a polishing pad used in chemical mechanical planarization of semiconductor wafers, the apparatus comprising a plurality of non-semiconductor qualifying members including at least one collimated hole structure, wherein the collimated hole structure forms multiple channels within the qualifying member, the qualifying members configured to simulate wear on the polishing pad similar to application of the polishing pad to semiconductor wafers.

2. The apparatus of claim 1, wherein at least one of the qualifying members comprises a material selected from the group consisting of borosilicate glass, soda lime glass, high-lead glass, and silicon oxide.

3. The apparatus of claim 1, wherein the qualifying members have at least two different shapes.

4. The apparatus of claim 1, wherein the qualifying members are positioned adjacent to each other and arranged such that a combination of the qualifying members approximates a shape of one of the semiconductor wafers.

5. The apparatus of claim 1, wherein at least one of the qualifying members is formed in the shape of a bar.

6. The apparatus of claim 1, wherein at least one of the qualifying members is formed in the shape of a disc.

7. A method for qualifying a polishing pad used in chemical mechanical planarization of semiconductor wafers, the method comprising:

providing at least one non-semiconductor qualifying member formed with at least one capillary tube array, wherein the capillary tube array forms multiple channels within the qualifying member;

pressing the qualifying member against the polishing pad;

simulating wear on the polishing pad caused by polishing a semiconductor wafer by moving the qualifying member along the polishing pad along a trajectory used to polish the semiconductor wafer.

8. The method of claim 7, wherein the polishing pad contains an amount of slurry.

9. The method of claim 7, wherein the polishing pad comprises a fixed abrasive.

10. The method of claim 7, wherein the pressing of the qualifying member is conducted with a force of between about 0.5 psi and about 4.0 psi.

11. The method of claim 7, wherein the qualifying member comprises a material selected from the group consisting of borosilicate glass, soda lime glass, high-lead glass, and silicon oxide.

12. The method of claim 7, wherein the qualifying member is removably attached to a retaining fixture.

13. The method of claim 7, wherein the qualifying member has a height of between about 0.1 centimeters and about 10 centimeters.

14. The method of claim 7, further comprising producing a wear pad study from the simulated polishing of the semiconductor wafer.

15. The method of claim 7, further comprising qualifying the polishing pad without using any semiconductor wafers.

16. The method of claim further comprising qualifying the polishing pad prior to the polishing pad being applied to any semiconductor wafers.

17. The method of claim 7, further comprising qualifying a polishing process used by the polishing pad by qualifying the polishing pad prior to any polishing pads using the polishing process being applied to any semiconductor wafers.

18. The apparatus of claim 1, wherein at least one of the qualifying members has a density and structure similar to the semiconductor wafers.

19. The apparatus of claim 1, wherein a height of at least one of the qualifying members is at least that of one of the semiconductor wafers.

20. The apparatus of claim 1, wherein the multiple channels formed by the collimated hole structure of at least one of the qualifying members extends to an edge of the at least one of the qualifying members.

* * * * *